United States Patent [19]

Bergendorff

[11] 4,007,542

[45] Feb. 15, 1977

[54] STRAIGHTEDGE

[76] Inventor: Fred R. Bergendorff, 7429 Orien, La Mesa, Calif. 92041

[22] Filed: July 3, 1975

[21] Appl. No.: 593,170

Related U.S. Application Data

[63] Continuation-in-part of Ser. No. 512,470, Oct. 7, 1974, abandoned, which is a continuation-in-part of Ser. No. 397,603, Sept. 14, 1973, abandoned.

[52] U.S. Cl. ..... 33/77; 33/107 R

[51] Int. Cl.[2] ..... B43L 13/14

[58] Field of Search ..... 33/77, 107, 111

[56] References Cited

UNITED STATES PATENTS

| | | | |
|---|---|---|---|
| 159,294 | 2/1875 | Belcher et al. | 33/107 R |
| 854,325 | 5/1907 | Belcher | 33/107 R |
| 895,137 | 8/1908 | Alexander | 33/107 R X |
| 1,007,353 | 10/1911 | Henschel | 33/107 R |
| 2,182,027 | 12/1939 | Little | 33/107 R |
| 3,492,727 | 2/1970 | Klok | 33/77 |

*Primary Examiner*—Charles E. Phillips
*Attorney, Agent, or Firm*—George J. Netter

[57] ABSTRACT

A straightedge having incremental markings along two opposite edges, the spacing of the markings being progressively decreased toward a theoretical vanishing point to provide a perspective scale. The straightedge has a rigid spine, with two edge members of transparent material on which the graduations are marked. The edge members are offset toward opposite faces of the spine, so that when one member is held flat on a work surface, the other member is raised above the surface, allowing the raised edge to be used to guide or support a pen, brush, or the like without the ink or other fluid marking material running under the edge. The raised edge may be rocked into contact with the work surface and the upper edge serving as a guide or support. In a further manner of use, the straightedge facilitates rapid basic layout of a perspective drawing, such as an architectural rendering.

1 Claim, 15 Drawing Figures

FIG. 7.
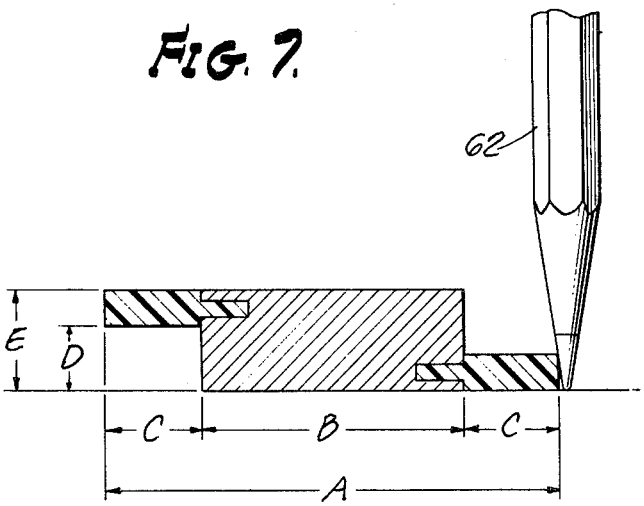
FIG. 8.
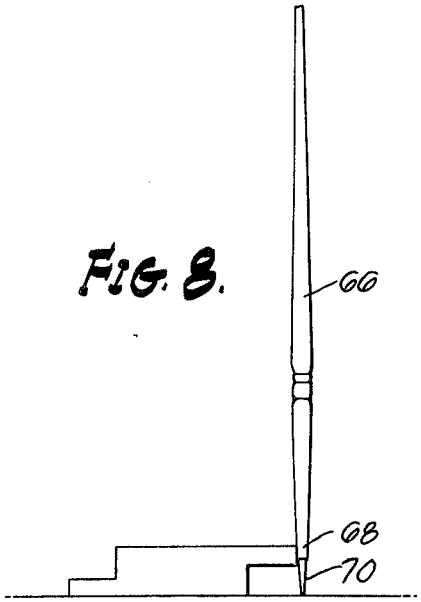
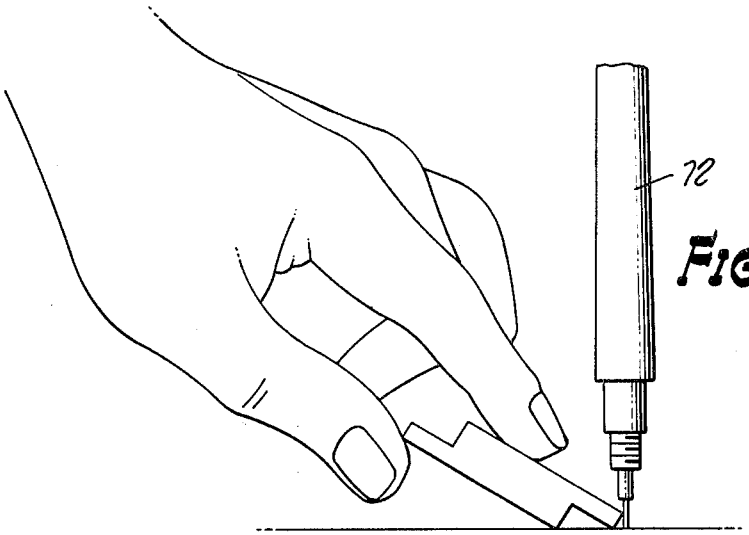
FIG. 9.
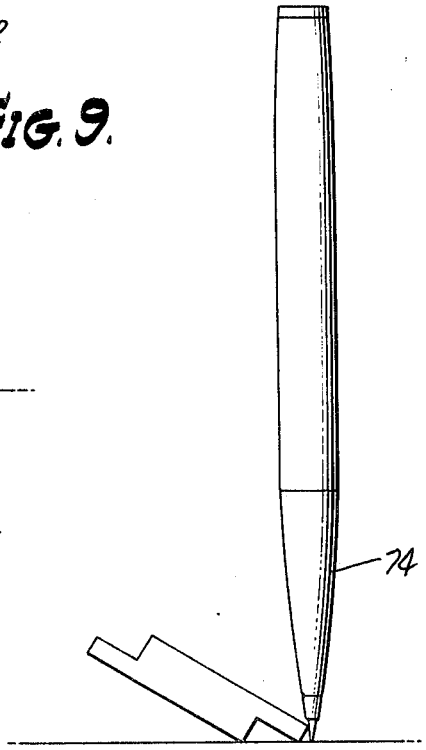
FIG. 10.
FIG. 11.
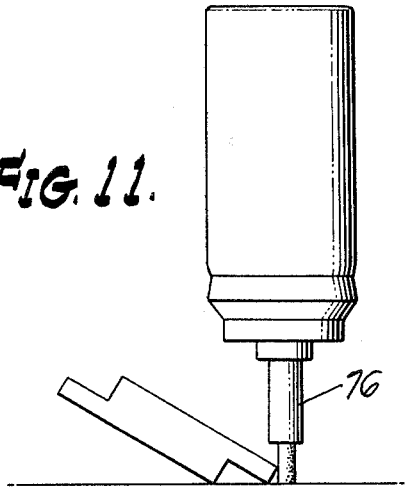

STRAIGHTEDGE

SUMMARY AND OBJECTS OF THE INVENTION

This is a continuation-in-part application of Ser. No. 512,470, filed Oct. 7, 1974 for "Two Level Perspective Straight Edge", now abandoned, which is a continuation-in-part application of Ser. No. 397,603, filed Sept. 14, 1973 for "Two Level Perspective Straight Edge", now abandoned.

The present invention relates generally to a straightedge or ruler, and, more particularly, to an improved straightedge which is adaptable for use with a variety of different drafting instruments and facilitating layout of a perspective drawing.

The straightedge described herein is a multi-purpose instrument which can be used in the initial layout of a perspective rendering and in the drawing and lining-in of the rendering with a variety of media. The straightedge has a rigid spine with transparent edge members attached to opposite edges, the edge members being marked with graduations which diminish in spacing toward one end to provide a perspective scale. For convenience, the graduations on one edge diminish toward a theoretical vanishing point on the right hand side of a drawing, and the graduations on the other edge diminish to a left hand vanishing point. The edge members are offset on two levels, with one face of each substantially flush with one face of the spine and the other face inset from the other face of the spine. When one edge member is flat on the surface of the drawing, the other edge member is spaced above the drawing and may be used as a guide for pens, brushes, felt tipped markers and the like, whose fluid marking media would run under a normal straightedge resting on the drawing. The upper offset edge may be rocked or tipped into contact with the work surface, thereby providing front and rear edges of differing heights for use with appropriate drafting instruments.

A primary object of this invention is to provide a new and improved two-level straightedge.

Another object is to provide a straightedge which is graduated for marking reference spacing of structural elements in perspective proportion.

Another object of this invention is to provide a perspective straightedge having edge members which are offset so that one edge is raised in spaced relation to the working surface when the straightedge is resting on a work surface.

DESCRIPTION OF THE DRAWING

FIG. 7 is an end elevational view of the straightedge showing use with a pencil.

FIG. 8 is an end elevational view of the straightedge showing use with a brush.

FIGS. 9–11 show the straightedge tipped forwardly with the offset edge contacting the work surface and showing use with a pencil, ball-point pen and felt brush marker, respectively.

DESCRIPTION OF A PREFERRED EMBODIMENT

Figure 1:
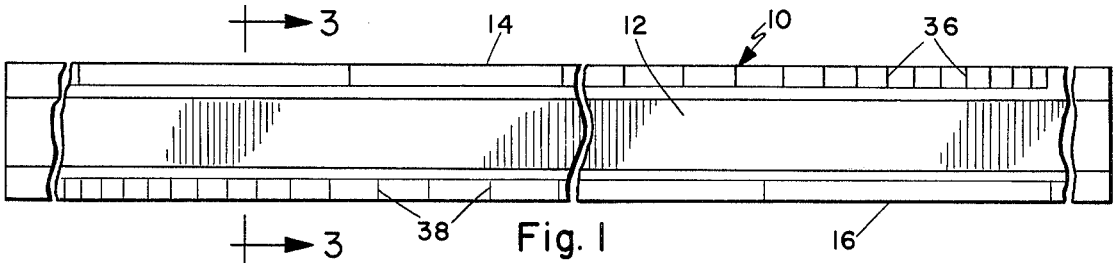
FIG. 1 is a top plan view of the straightedge.

The straightedge 10 comprises an elongated rigid spine 12 with longitudinally extending edge members 14 and 16 fixed to opposite edges. Spine 12 is preferably of wood, or other such material, which will resist bending in use, and edge members 14 and 16 are preferably of transparent plastic material. Each edge member has a thin longitudinal rib 18, which fits in and is bonded into a corresponding groove 20 in the spine 12 to secure the edge members thereto.

Figure 3:
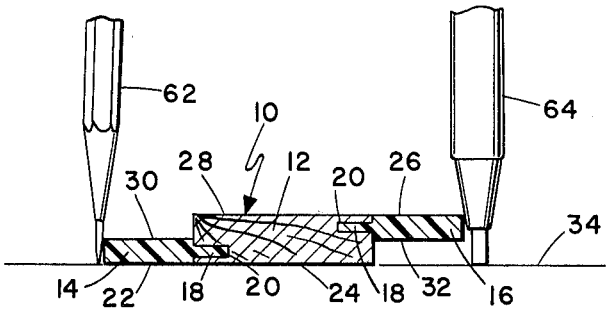
FIG. 3 is an enlarged sectional view taken along the line 3—3 of FIG. 1, and showing the use of the straightedge.

The spine 12 is of flat rectangular cross section and the edge members are offset to opposite faces of the spine. The face 22 of edge member 14 is substantially flush with the face 24 of spine 12, and the face 26 of edge member 16 is substantially flush with the other face 28 of the spine. As illustrated in FIG. 3, the edge members are thinner than spine 12 and have inset faces. Face 30 of edge member 14 is thus inset from face 28 of spine 12, and face 32 of edge member 16 is inset from face 24 of the spine. In normal use, one edge member and the associated flush face of the spine are flat on the work surface 34, while the other edge member is raised clear of the work surface.

Figure 2:
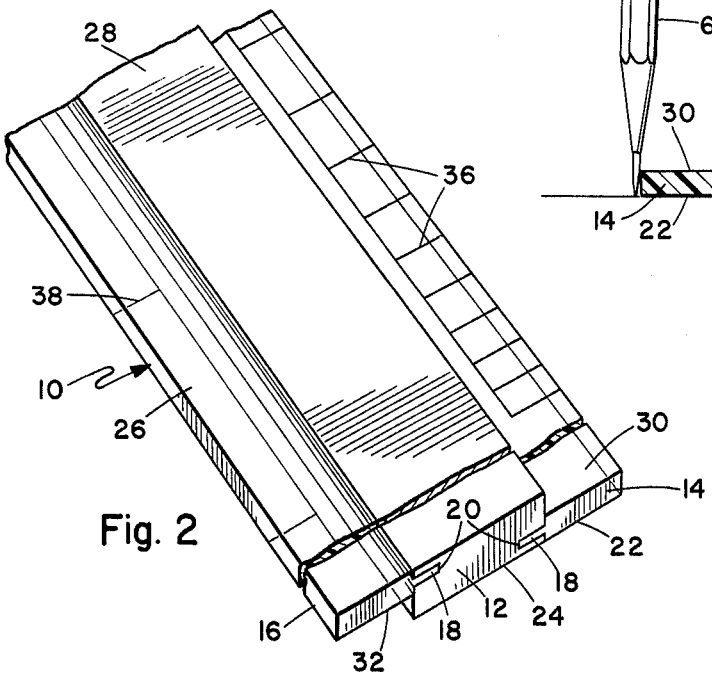
FIG. 2 is an enlarged perspective view of one end of the straightedge.

The inset faces are provided with graduated markings spaced to indicate equal increments with perspective foreshortening. As illustrated, face 30 has markings 36 which diminish in spacing from left to right, toward a theoretical vanishing point at the right of the drawing area. Face 32, on the underside as viewed in FIGS. 1 and 2, has markings 38 which diminish in spacing from right to left, toward a left hand vanishing point. When the straightedge is turned over by rotation about its longitudinal axis, face 32 and its markings 38 will be uppermost for use.

Figure 4:
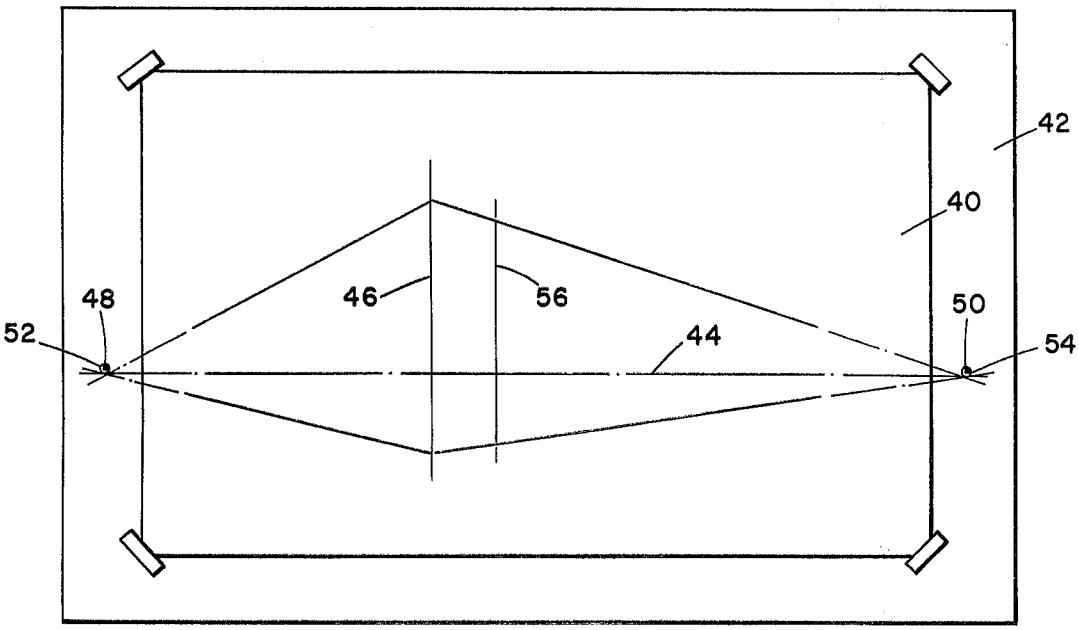
FIG. 4 illustrates the initial preparation of a drawing ready for use of the straightedge in making perspective elements.

In making a perspective rendering as used in architecture, which is an important use for the instrument, a drawing sheet 40 is attached to a board 42, as in FIG. 4, and a suitable horizon line 44 is established. A vertical reference line 46 is drawn, representing the vertical of the subject structure nearest to the eye, and the desired vanishing points 48 and 50 are located on the horizon line 44. Push pins 52 and 54, or similar position markers, are inserted at the vanishing points 48 and 50, respectively, to serve as reference pivots for the straightedge. Vertical line 46 is scaled to an appropriate height for the structure relative to horizon line 44, and basic guide lines are drawn from the top and bottom of the vertical line projected to the opposite vanishing points.

Figure 5:
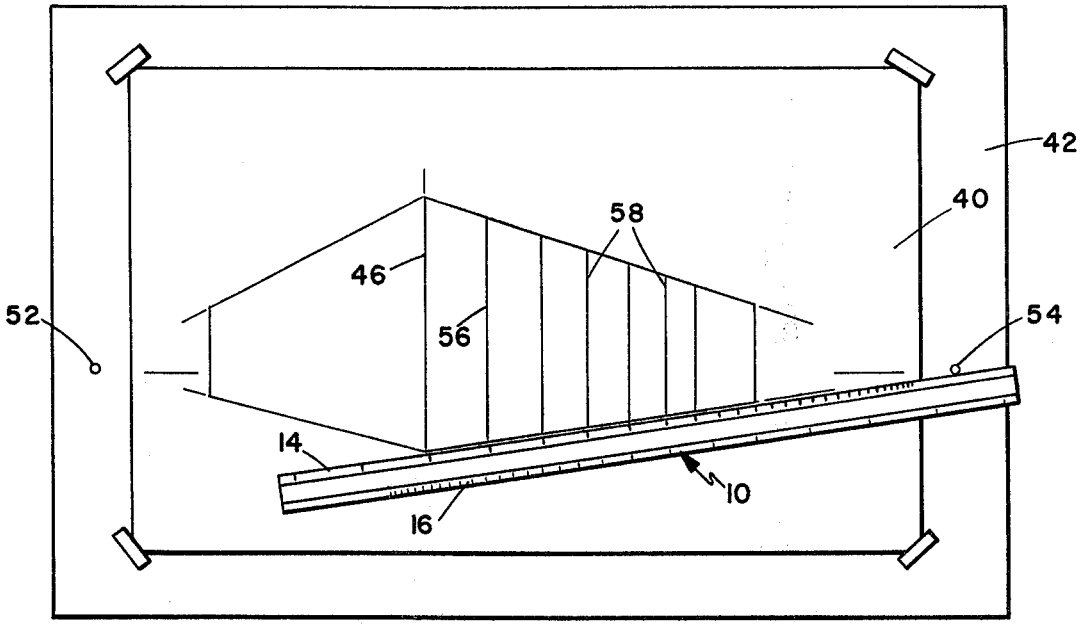
FIG. 5 illustrates the marking of spaced elements, as along one side of a building.

To set up the proper proportions, a known basic module of the structure is scaled by drawing a vertical reference line 56 adjacent line 46. In the foreground of the structure the perspective foreshortening is minimal and this is easily accomplished by eye. Straightedge 10 is then placed against push pin 54 and aligned with the lower end of vertical line 40, so that the edge member 14 extends along the lower wall line of the structure. The straightedge is then slid longitudinally until two adjacent markings 36 most closely match the modular spacing between vertical lines 46 and 56, as in FIG. 5. All other equal or multiple modules can then be marked at the appropriate markings 36 along the perspective scale. When vertical guide lines 58 are drawn from those marks, the modular divisions of the wall will be indicated in correct perspective proportion.

Figure 6:
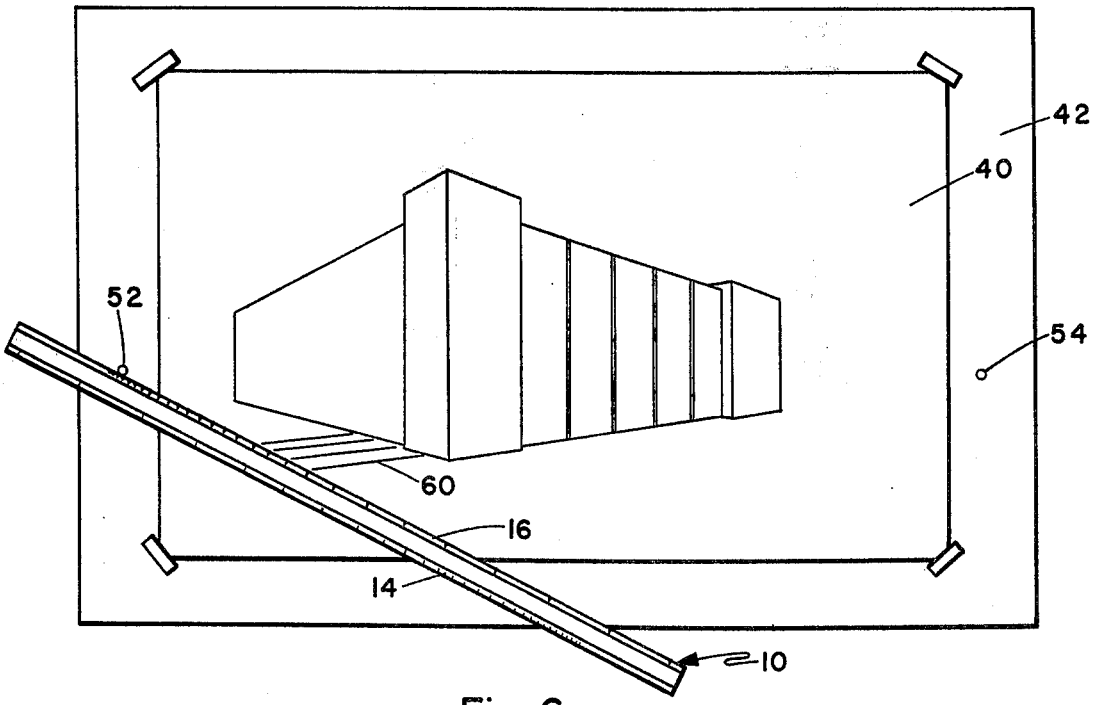
FIG. 6 illustrates a partially completed drawing of the building, with the straightedge in further use.
Figure 12:
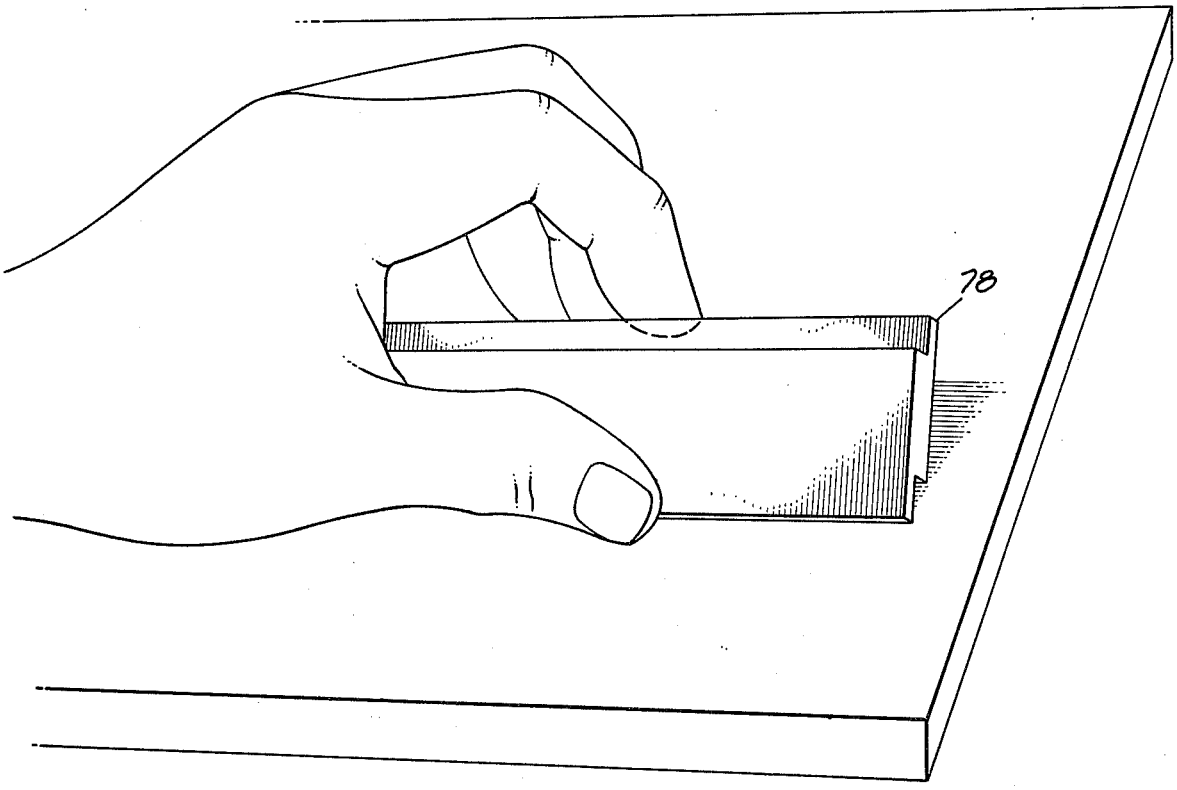
FIGS. 12–15 show the straightedge tipped backwardly with the rear offset edge contacting the work surface and shown in use with a brush and knife blade, respectively.
Figure 13:
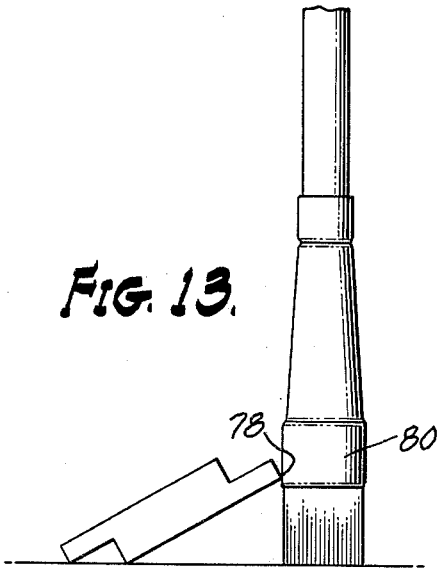
Figure 14:
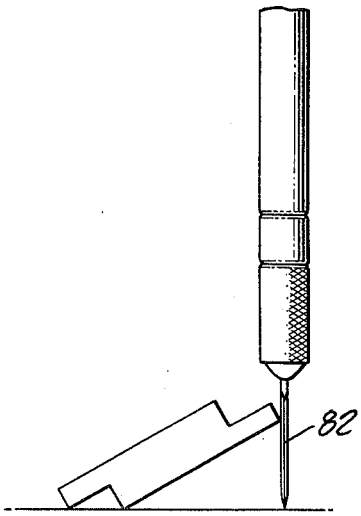
Figure 15:
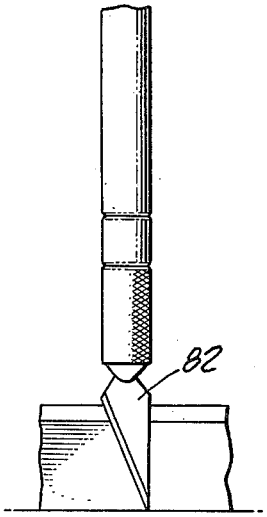

By turning the straightedge over and placing it against push pin 52, any required modular spacings can be marked along the other visible wall of the structure. In FIG. 6, for example, the straightedge is shown as being used to mark parking space divisions 60 along a line projected through vanishing point pin 52.

Many architectural renderings are made with the vanishing points within reasonable limits, often with one point closer to the eye or near point reference, as illustrated. The inclination of the basic structure lines to the points will thus be within a reasonable range and foreshortening is not unduly distorted. The markings on the two edge members may be made with different degrees of foreshortening to suit the most commonly used perspective angles, or several straightedges may be made with suitable scales for a wide range of effective viewing angles. It should be understood that the instrument is not intended for precision measurement, but for rapid layout of basic structure in visually acceptable proportions. The straightedge may be made in any convenient length, according to the size of drawing to be made and to reach the vanishing points for proper alignment.

In addition to use as an aid in making perspective drawings, the described straightedge has been specifically constructed for use with a great variety of different drafting instruments. For example, in the normal mode of use (FIG. 3), one spine face and one edge member 14 or 16 are held flat against the work surface and a drawing instrument such as a pencil 62 is supported against the outer edge of the edge member during use.

In FIG. 8 the straightedge is oriented on the work in the same manner as FIG. 7, except that now the raised edge member is used. As shown, the spacing is such that when using a brush 66, the lowermost extremity of the brush holder 68 is supported at the side when the end of the brush hairs 70 contact the work surface.

FIGS. 9–11 depict use where the forward normally spaced edge member is rocked or tipped forwardly until the outer edge thereof contacts the work surface. This mode of use is particularly advantageous where the drawing instrument has a relatively extended marking element. As shown when a so-called mechanical pencil 72, ball-point pen 74, or felt marker 76, is used, the marking element of each is supported solely by direct contact with the single line edge between the straightedge flat upper surface and the outer side surface. In this way only minimal marking of the straightedge by ink, graphite or other medium is produced, and ink is not induced to flow along a straightedge surface onto the work surface.

FIGS. 12-15 show a still further mode of use in which the straightedge is tipped about its longitudinal axis until the normally uppermost edge member is brought into contact with the work surface. A single supporting edge 78 is provided which is held spaced from the work surface an amount considerably exceeding that in FIGS. 9–11. This additional spacing enables ready use of a large brush 80 or drafting knife blade 82. In the case of the knife blade, not only is the blade laterally supported, but it is supported along a single-line edge and at an angle which prevents inadvertent cutting of the straightedge during use.

In accordance with the practice of this invention, there is provided a straightedge having four different modes of use in which the guiding or lateral supporting means is selectively maintainable at different heights for each of the modes, whereby the various types of drafting and writing or drawing instruments are used in their most efficient manner. To most advantageously accommodate the many different drafting tools, the relative dimensions of the straightedge are critical. A practical embodiment of the described straightedge had the following dimensions as referenced in FIG. 7: A, 1–9/16 inches; B, ⅞ inches; C, ⅜ inches; D, 3/16 inches; and E, ⅜ inches.

What I claim is:

1. A two level perspective straightedge, comprising: an elongated, substantially flat rigid spine having opposed faces and edges; longitudinally extending transparent edge members fixed to opposite edges of said spine, the edge members being offset in opposite directions with one face of one edge member flush with a first face of the spine and the other face of said one edge member inset from the second face of the spine, one face of the other edge member flush with said second face of the spine and the other face of said other edge member inset from said first face of the spine; and each of said edge members having graduated markings on the inset faces thereof in increments which diminish in spacing from one end to the other in perspective proportion and wherein the direction of diminishing spacing of the markings on one of said edge members is in the opposite direction from the direction of diminishing spacing of the markings on the other of said edge members.

* * * * *